United States Patent [19]

Scholes

[11] 4,336,275

[45] Jun. 22, 1982

[54] METHOD AND APPARATUS FOR LUBRICATING CONDUCTIVE SUBSTRATES

[75] Inventor: Addison B. Scholes, Muncie, Ind.

[73] Assignee: Ball Corporation, Muncie, Ind.

[21] Appl. No.: 188,335

[22] Filed: Sep. 18, 1980

[51] Int. Cl.[3] ..... B05D 1/04; B05B 5/00

[52] U.S. Cl. ..... 427/27; 427/33; 427/209; 48/627; 48/630; 48/635

[58] Field of Search ..... 118/627, 629, 630, 634, 118/635, 638; 427/27, 32, 33, 209

[56] References Cited

U.S. PATENT DOCUMENTS

| | | | |
|---|---|---|---|
| 3,323,934 | 6/1967 | Point | 427/33 |
| 3,380,845 | 4/1968 | Shapiro et al. | 118/638 |
| 4,073,966 | 2/1978 | Scholes | 427/32 X |

FOREIGN PATENT DOCUMENTS

| | | | |
|---|---|---|---|
| 2433006 | 2/1975 | Fed. Rep. of Germany | 118/629 |

*Primary Examiner*—Shrive P. Beck

*Attorney, Agent, or Firm*—Jenkins, Coffey, Hyland, Badger & Conard

[57] ABSTRACT

Method and apparatus are disclosed for electrostatically dispersing lubricating particles onto the surfaces of electrically conductive substrates. In the method and apparatus, discrete sheets, for example, of electrically conductive substrate are moved through a housing in which the lubricating particles are deposited. The conveying means that carry the sheets through the housing electrically isolate the sheets in space while they are exposed to deposition of the particles. To avoid the accumulation of voltage on the sheets during deposition and to avoid inhibition of deposition that may result therefrom, at least two deposition chambers are used and each deposition chamber receives a supply of lubricating particles for deposition on the sheets. Independent electrode means are provided in each deposition chamber. Voltages of opposite polarities are applied to the independent electrode means of each deposition chamber to electrically charge the particles in each deposition chamber with opposite polarities and to deposit oppositely charged particles on the sheets.

5 Claims, 4 Drawing Figures

METHOD AND APPARATUS FOR LUBRICATING CONDUCTIVE SUBSTRATES

This invention relates to a novel and improved method and apparatus for electrostatically depositing particles of a lubricating material onto ungrounded metal sheets.

In the production of metal cans and other articles of manufacture, it is often necessary to provide slight amount of lubrication material upon the surface of metal sheets before storing the metal or subjecting the metal stock to further forming operations, such as passing the stock through various forming dies, or for other reasons. Failure to apply lubrication prior to such forming operations results in severe scraping and galling of the dies, rendering them useless for continued service. In addition, failure to apply lubrication often results in deformed and defective finished articles. Also, as metallic surfaces are often provided with suitable ornamental effects, it is frequently desirable to provide the decorated metallic surface with lubrication immediately following the surface decorating process. Here again lubrication is frequently required to enable the manufacturer to pass the decorated sheet or material through forming dies to punch and form the material without galling the dies or causing defective materials to be produced. In all cases, it is necessary to apply a fairly controlled amount of lubrication and to attempt to distribute it uniformly on the metal surfaces since excessive or uneven lubrication can and often does give rise to its own attendant problems, as is also well known in the art. For instance, excessive wax lubrication not only wastes materials, but it may accumulate on forming die surfaces and tend to "tack" or "weld" lubricated sheets together upon mutual planar contact.

A method and apparatus to provide such lubrication is known. In the known method and apparatus, a substrate to be coated is moved through a housing in which the substrate is lubricated. A lubricant, which is preferably solid at room temperature, is heated to form a liquid. The liquid lubricant is then sheared within an air-fed orifice into an airborne mist of droplets. Larger droplets are filtered out of the air flow by gravity, baffles, air flow forces, and inertia effects to leave only a cloud of extremely small, substantially uniformly sized, spheroid particles which are substantially independent of gravity forces. This cloud is then migrated or drifted to one or more deposition chambers, preferably formed by electrically non-conductive walls, having a plurality of electrodes therein. One known apparatus includes a housing forming two deposition chambers, one on each side of the path taken by the substrate as it passes through the housing. A high voltage is applied to the electrodes within the chambers. The small particles acquire a high electrical charge giving rise to electrostatic forces which uniformly disperse the particles onto a conducting substrate as it passes through the chambers. The deposited particles form a uniform, substantially random distribution of lubricating spheres over the surface of the substrate. In the preferred embodiment, the lubricant spheroids become frozen to a solid state before being dispersed onto the conductive surface. Such method and apparatus is disclosed in U.S. Pat. Nos. 4,066,803; 4,073,966; and 4,170,193.

In the use of such a method and apparatus, the substrate to be lubricated may not be grounded, or connected with ground potential. Such a connection sometimes interferes with the lubrication process and the uniformity of the lubrication. When discrete metal sheets are moved through the deposition zone, they are frequently electrically isolated while deposition of the charged particles takes place. Such a condition occurs when the sheets to be coated are carried through the deposition chamber by conveyor means including electrically non-conductive belts.

As deposition of the charged particles of lubricating material occurs, the isolated substrate accumulates an electrical charge, resulting in a voltage rise on the substrate that both inhibits deposition of lubrication and provides a source of current for sparking as the substrate comes within sparking distance of an object at ground potential. Sparking can act as a potential source of ignition if sufficient energy is dissipated in the discharge. Further, the preferred method and apparatus are protected against sparking from the electrodes by a microprocessor electrical control system. Sparking from the ungrounded substrate and sheets can result in an unwanted signal that frequently terminates coating operations, and in electrical transients that prevent proper operation of the electrical apparatus control.

The improved method and apparatus of this invention includes means to form and supply a cloud of finely divided particles from a supply of lubricating material, means providing a housing through which the conductive substrate is passed longitudinally, and means to move an ungrounded substrate through the housing. The housing forms at least a pair of chambers, preferably one on each side of the moving conductive substrate. Each housing chamber receives a supply of finely divided particles of lubricating material. Electrodes are provided within each chamber of said housing and are spaced from the path followed by the moving substrate. Voltage is applied with the electrodes to create an electrical charging of particles within each chamber of the housing, with one chamber providing electrical charging of one polarity and the other chamber providing electrical charging of the opposite polarity. One or more voltage sources may be used.

In this method, an ungrounded substrate is moved through the deposition zone, and while it is electrically isolated in space therein, it is exposed to deposition from both chambers. The substrate receives charged particles of both polarities upon the surfaces exposed to the chambers during movement through the deposition zone. Because the opposite charges cancel in their electrical effect, the ungrounded substrate does not accumulate a significant voltage, and sparking and inhibition of deposition are avoided. The charged particles received by the substrate in this method and apparatus include generally charged lubricating particles, ions, and electrons.

The term lubricating material denotes low-melting organic mixtures or compounds of relatively high molecular weight which are normally solid at room temperature and generally similar in composition to fats and oils. Although this generally embraces the hydrocarbons and more particularly the paraffinic hydrocarbons, other compounds such as esters or fatty acids and alcohols are also included. Generally, such substances are non-toxic in nature and are free from objectionable odor and color. These lubricating materials are generally combustible, and have good dielectric properties. Further, the lubricating materials may be divided into two groups, natural and synthetic. The natural lubricating materials include beeswax, lanolin, shellac wax, carnauba, petroleum waxes including paraffin, microcrystalline, and petrolatum. The synthetic waxes include ethylenic polymers and polyol ether-esters including polyethylene glycols and methoxypolyethylene glycols and sorbitol, chlorinated naphthalenes and various hydrocarbon types produced by synthetic means such as the Fischer-Tropsch.

Other features and advantages of the invention will become more fully apparent from the following drawings and description of the preferred embodiment in which.

Figure 1:
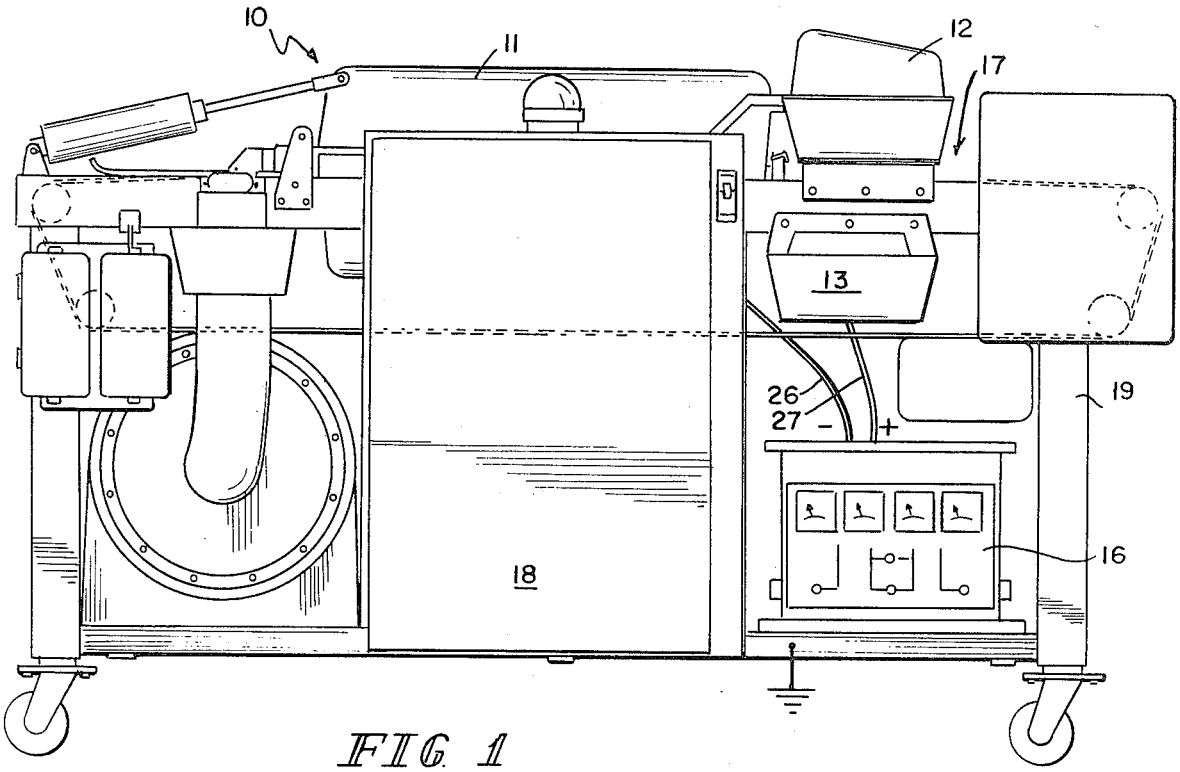
FIG. 1 is a side view of a lubricating apparatus and auxiliary equipment of the invention.

Turning now to the drawings and particularly FIG. 1, a specific electrostatic lubricating apparatus 10 is shown having a housing 11 connected with a pair of generators 12 and 13 to form a cloud of lubricating material and to communicate the particles to the housing 11. The housing 11 is provided with a pair of openings 14 and 15 (FIG. 2) located centrally in the housing 11 through which the substrate to be coated is moved. The apparatus includes a source of high voltage 16 having outputs of both positive high voltage and negative high voltage. The high voltages are, typically, in the range of 20,000 to 40,000 volts average direct current with respect to ground. The apparatus also includes conveyor means 17 to move metal sheets to be coated through the housing 11 and openings 14 and 15. An electrical control enclosure 18 houses an electrical control with a microprocessor to perform logical processing of control and monitoring signals. The apparatus components are supported on a metallic structure 19 which is electrically grounded when installed.

Figure 2:
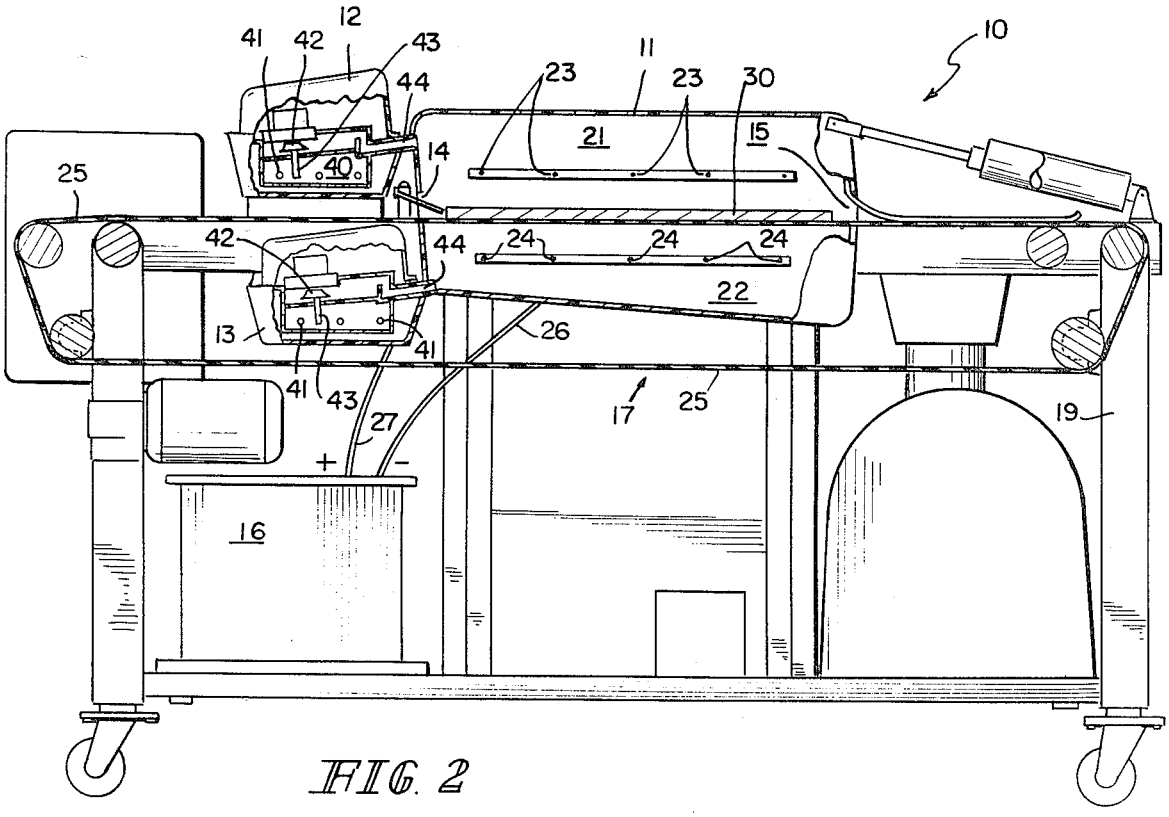
FIG. 2 is a partial sectional view of the lubricating apparatus of FIG. 1 taken from the side opposite to the side shown in FIG. 1.

FIG. 2 is a partially sectioned side elevational view of the embodiment of FIG. 1 from the side opposite that shown in FIG. 1. As illustrated in FIG. 2, the lubricating apparatus 10 includes a housing 11, which preferably is formed of an electrically non-conductive material such as polypropylene or glass-reinforced polyester resin. The housing 11 has an upper deposition chamber 21 which is above the path followed by the conductive substrate in passing through the housing and a lower deposition chamber 22 which is positioned below the path. Both deposition chambers 21 and 22 may be divided into a plurality of chambers by partitions to promote uniformity of deposition.

Figure 3:
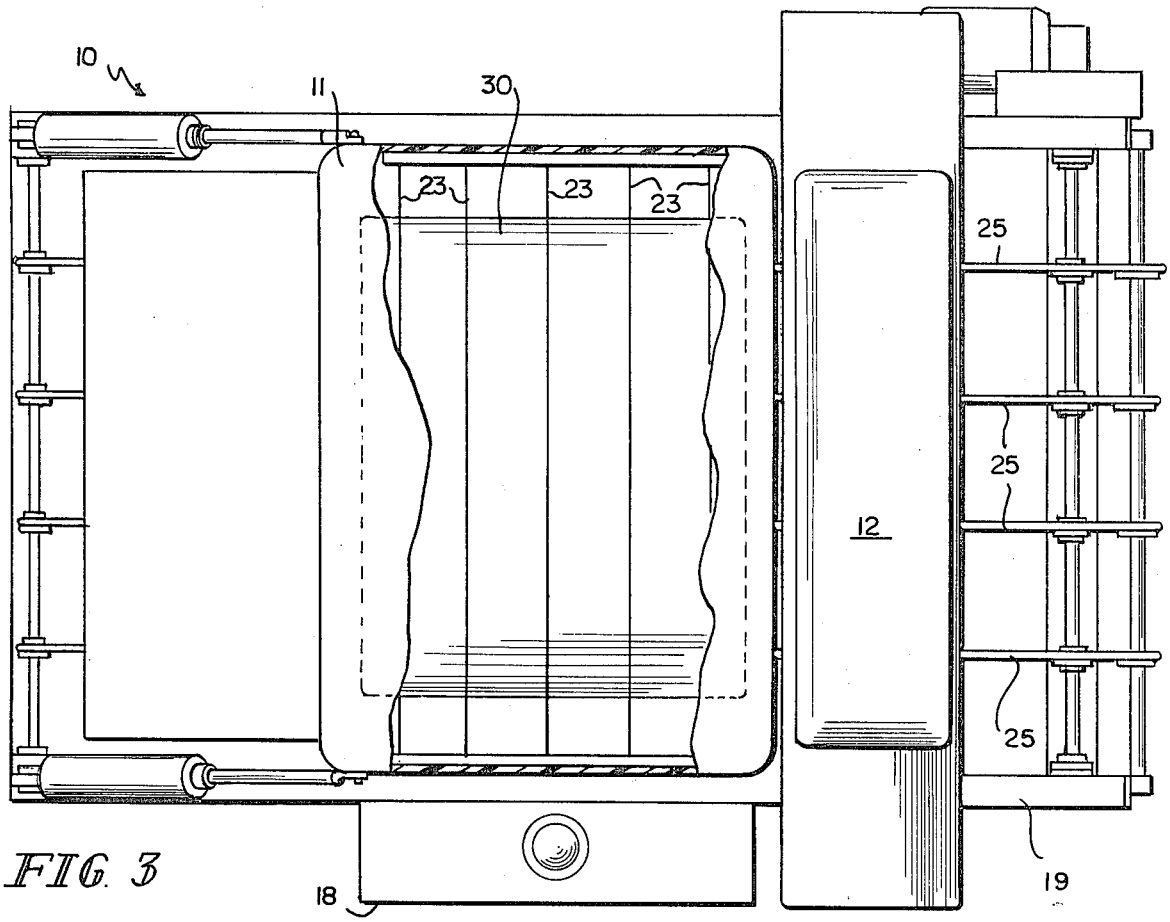
FIG. 3 is a partial sectional plan view of the lubricating apparatus of FIG. 1 and FIG. 2 showing the interior of the deposition chamber.
Figure 4:
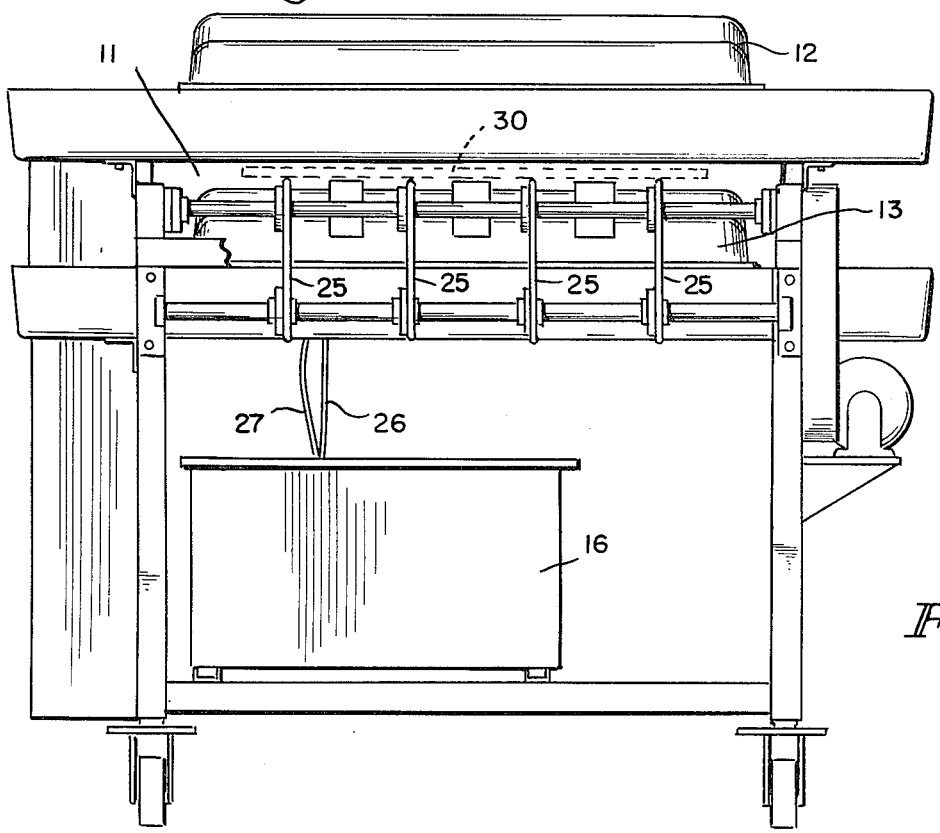
FIG. 4 is a view of the end of the lubricating apparatus of the above figures as seen from the right of FIG. 1.

The path of the substrate through the housing 11 is determined by the conveyor means 17. In the apparatus, such conveyor means comprises a plurality of belts 25 (FIGS. 2–4) of a flexible, electrical non-conductor, such as rubber-like material or neoprene. A metal sheet 30 to be coated is carried by the conveyor means 17 of the apparatus through housing 11 as shown in FIGS. 2 and 3. In its movement through the apparatus and during its coating, the substrate 30 is electrically isolated in space by the electrically non-conductive belts 25 because the substrate 30 is out of contact with any grounded electrical conductor, and there is no path to ground for electrical charge that may accumulate on the substrate 30.

Lubricating material to be deposited is provided to the deposition chamber 21 and 22 by one or more particle generators. Particle generators 12 and 13 may be provided, one for each deposition chamber, and may include a plurality of individual particle-generating units, one associated with each partitioned chamber within the deposition chambers 21 and 22, if partitioning is used. Each particle generator 12 and 13 includes a reservoir 40 which contains the lubricant material to be dispersed onto the substrate. Preferably, the lubricant is solid at room temperature; and accordingly, heating elements 41 are positioned within the reservoir in order to heat the lubricant to a liquid state. Air or another suitable gas supply is coupled to a venturi atomizer 42 which is positioned in the upper portion of the mist generator. The passage of air under pressure into the venturi causes a pressure drop at the top of feedline 43, thereby causing the liquefied lubricant to be sucked up into the venturi where the lubricant is sheared into individual droplets. In their travel within the generators 12 and 13, the larger droplets are returned to the bath of liquid lubricant. The remaining particles migrate through baffle filter arrangements and the outlet chamber 44 in the upper portion of each particle generator into the deposition chambers 21 and 22. Large particles are filtered out so that only particles of sufficiently small size, e.g., on the order of ten microns in diameter or less, and the majority on the order of one micron, are supplied into the deposition chambers. A most preferred distribution of particle size is in a range of between about four microns to about one micron. The migration of the small particles is so slow during this supply process that the particles preferably solidify and become dry and accordingly undertake the characteristics of solid spheres. The particles enter the deposition chambers 21 and 22 in the form of a quiescent cloud which is substantially uniformly distributed across the width of the deposition chambers 21 and 22.

Electrodes 23 are positioned in deposition chamber 21 above the path of movement of the substrate. The electrodes 23 are charged to a high voltage of one polarity with respect to ground. Electrodes 24 are positioned in deposition chamber 22 below the path of movement of the substrate. The electrodes 24 are charged to a high voltage having the polarity opposite to that of electrodes 23. For example, when electrodes 23 are connected to a positive high voltage, electrodes 24 are connected to a negative high voltage, and vice versa. The electrodes 23 and 24 are typically wires having a diameter of 0.009 inch extending transversely of the path of the substrate and spaced a suitable distance, e.g., five inches, above and below the path of the conductive substrate. Charging of the electrodes 23 and 24 may be accomplished by connection with a high voltage supply 16 having both a negative output 26, a positive output 27, or by separate supplies, one with a positive voltage output and one with a negative voltage output.

The lubricating particles within the deposition chambers become charged and acquire a relatively large charge to mass ratio. The particles in one deposition chamber, e.g., chamber 21, acquire a charge of one polarity and the particles in the other deposition chamber, e.g., chamber 22, acquire a charge of the opposite polarity. The particles tend to be randomly dispersed before being charged but also are randomly and uniformly dispersed by their charge.

In accordance with this coating method, for example, individual sheets 30 of substrate to be lubricated are carried by the electrically non-conductive belts 25 through the apparatus. As the individual sheet or sheets 30 are moved through the housing 11 and the deposition chambers 21 and 22, charged particles of lubricating material are urged by electrostatic forces onto the upper and lower surfaces of the sheet 30. The particles from one of the deposition chambers impart a charge of one polarity to the sheet, and the particles from the other deposition chamber impart a charge of the opposite polarity to the sheet. The opposite charges carried to the conductive substrate cancel in their charging effect upon deposition; and an accumulation of charge of one polarity and a resulting voltage rise on the substrate are avoided.

The high voltages applied to the electrodes in each deposition chamber are preferably of about equal absolute magnitude although of opposite polarity. Typically, a voltage of 20,000 to 40,000 volts positive with respect to ground will be applied to one set of electrodes and a voltage of 20,000 to 40,000 volts negative with respect to ground will be applied to the other set of electrodes. With such an arrangement, the rate of particle charging in each deposition chamber and the rate of deposition of charged particles will be about equal. Adjustment of each voltage can be provided to equalize charging and deposition more effectively if necessary.

It is not necessary that operation result in equal rate of deposition of positive and negative charges. It is advisable, however, that the rates of charging and deposition be such that only a small net charge accumulates on the substrate so that sparking is either avoided until the substrate is beyond the electrical environment of the apparatus or is reduced to such a minimal energy level that no deleterious effect occurs from any resulting spark.

Use of the above method and apparatus results not only in safer and more reliable lubrication of sheets, but also avoids voltage build-up on the substrate during lubrication that inhibits the rate of lubrication deposition.

Other embodiments of the invention may be devised within the scope of the claims that follow.

What is claimed is:

1. Apparatus for electrostatically coating metal sheets with a lubricant, comprising:

a housing having a first wall with an entry opening defined therein, a second laterally spaced wall having an exit opening defined therein, such entry and exit openings being of a size such as to readily accommodate movement of the sheet over a path between said openings through said housing, said path between said entry and exit openings being defined by electrically non-conductive carriers for the metal sheets, said housing including a first deposition chamber and a second deposition chamber with said first deposition chamber on one side of said path between said openings and said second deposition chamber on the other side of said path between said openings;

means to provide a supply of lubricating particles into said first and second deposition chambers;

first charging electrode means in said first chamber and second charging electrode means in said second chamber; and voltage supply means connected with the first charging electrode means to create deposition of charged lubricating particles having one polarity in said first deposition chamber and connected with the second charging electrode means to create deposition of charged lubricating particles having the opposite polarity in said second deposition chamber, whereby an accumulation of voltage on the moving sheet is avoided while said sheet is ungrounded.

2. Apparatus for electrostatically dispersing small particles of lubricating material onto a moving, ungrounded, electrically conductive substrate, said apparatus comprising:

means providing a supply of said lubricating material in liquid form;

means forming a cloud of small particles from said supply of liquid lubricating material;

means providing a housing through which said conductive substrate is passable longitudinally thereof;

means to move the ungrounded substrate through a central portion of said housing, said housing forming a chamber on each side of the moving conductive substrate, each housing chamber being provided with a supply of small particles of lubricating material;

means providing electrodes within each chamber of said housing, said electrodes being spaced from said moving substrate and adapted to charge the lubricating material particles; and means connected with the electrodes to create an electrical charging of the small particles within each chamber of the housing with one chamber having electrical charging of one polarity and the other chamber having electrical charging of the opposite polarity, said substrate receiving charged particles of both polarities upon the surface exposed to the chambers during movement through the housing without the accumulation of significant voltage.

3. Apparatus for manufacturing a lubricating substrate of electrically conductive material comprising:

a housing of electrically non-conductive material having at least one opening, encompassing the substrate on both sides and being structured to provide a deposition chamber for the substrate;

first means to move a substrate through the central portion of the housing and to electrically isolate the substrate while within the housing;

second means to divide the lubricating material into a spray, to remove from said spray the larger particles whose weight to diameter ratio is such that they will not remain suspended in substantially quiescent atmosphere, and to deliver an airborne suspension of the remaining smaller particles to said housing on both sides of the substrate;

first electrode means within the housing on one side of its central portion and spaced from one side of the substrate, and second electrode means within the housing on the other side of its central portion and spaced from the other side of the substrate;

first means to apply voltage of one polarity to said first electrode means of sufficient magnitude to create a charging field to charge small particles of lubricating material with one polarity and deposit said particles on said substrate; and second means to apply voltage of the opposite polarity to said second electrode means of sufficient magnitude to create a charging field to charge small particles of lubricating material with the opposite polarity and deposit said particles on said substrate.

4. The apparatus of claim 3 wherein said first electrode means and said second electrode means both comprise a plurality of wires having a small diameter and extending transversely of the path of the substrate.

5. A method for providing an ungrounded metallic substrate with lubricating particles, comprising moving the ungrounded metallic substrate through a deposition zone defined by a pair of deposition chambers, one on each side of the substrate, providing separate supplies of lubricating particles to be deposited in the deposition zone, charging the lubricating particles for deposition, one separate supply of lubricating particles being provided to one of the deposition chambers on one side of the substrate with electrical charges of one polarity and the other separate supply of lubricating particles being provided to the other deposition chamber on the other side of the substrate with electrical charges of the opposite polarity, and providing a simultaneous flow of charged particles of both polarities to the ungrounded metallic substrate at about the same rate while in the deposition zone to avoid an accumulation of high voltage during deposition.

* * * * *